United States Patent [19]

McLaughlin

[11] Patent Number: 4,775,148

[45] Date of Patent: Oct. 4, 1988

[54] ABDOMINAL EXERCISER

[76] Inventor: Gary G. McLaughlin, 13300 Wingo St., Arleta, Calif. 91331

[21] Appl. No.: 59,586

[22] Filed: Jun. 8, 1987

[51] Int. Cl.[4] ..... A63B 21/02

[52] U.S. Cl. ..... 272/139; 272/119; 272/135

[58] Field of Search ..... 272/135, 1, 139, 141, 272/142, 119, 93, 99; 128/28

[56] References Cited

U.S. PATENT DOCUMENTS

| | | | |
|---|---|---|---|
| 2,163,107 | 6/1939 | Shatto et al. | 272/119 |
| 2,220,593 | 11/1940 | Watson | 272/139 |
| 2,494,094 | 1/1950 | Horstman | 272/136 |
| 3,228,392 | 1/1966 | Speyer | 272/137 |
| 3,278,185 | 10/1966 | Bidopia et al. | 272/142 |
| 4,603,858 | 8/1986 | Raehzi | 272/137 |

*Primary Examiner*—Richard J. Apley

*Assistant Examiner*—J. Welsh

*Attorney, Agent, or Firm*—Timothy T. Tyson

[57] ABSTRACT

An abdominal exerciser for use with a belt to encircle an abdomen. A planar contacting plate rests on the abdomen. A retainer plate spaced from the contacting plate retains the belt in a relatively fixed location away from the skin of the abdomen. A coiled compression spring biases the retainer plate and belt away from the contacting plate. Exercise of the abdominal muscles is achieved by alternatively tightening the muscles to push the contacting plate toward the retainer plate and then relaxing the muscles allowing the spring to push the contacting plate away from the retainer plate. In an alternative embodiment, a weight is attached to the contacting plate by a second belt to stretch the muscles in the relaxed state and to require greater effort when the contacting plate is pushed toward the retainer plate.

14 Claims, 1 Drawing Sheet

ABDOMINAL EXERCISER

TECHNICAL FIELD

The present invention pertains to the exercising equipment art, and more particularly, to an exerciser attached to the user by a belt for exercising the abdominal muscles.

BACKGROUND ART

Various devices attached to the body by a belt have been developed to aid in the exercising of the abdominal muscles. For example, U.S. Pat. No. 2,163,107 discloses a gravity based device having a heavy curved weight for positioning on the abdomen when the user is supine. A belt from one side of the weight around the back of the user to the other side retains the weight in place on the body. The abdominal muscles are exercised by alternately partially relaxing against the force of the heavy weight and then tightening to push the weigh up. U.S. Pat. No. 3,278,185 shows a device similar in method of use that substitutes a spring for the weight. One end of the belt is attached to one end of the spring and the other end of the belt is attached to the other end of the spring. The muscles are exercised by tightening against the resistance of the spring to press the device outward. U.S. Pat. No. 3,532,340 shows a different type of exerciser secured to the body by a belt. A hula hoop type of ring is spaced from the belt and is attached to it by a plurality of springs. The user exercises the abdominal muscles in a standing position by holding the ring steady with his hands and then rotating the lower body against the force of the springs using the abdominal muscles. U.S. Pat. No. 4,603,858 shows a lever and spring based abdominal exerciser. An axle is secured to the abdomen by a belt. A lower lever of the device rests against the fronts of the legs. An upper lever of the device is held by the hands and rotates about the axle toward the lower lever. A spring between the levers resists movement. The abdominal muscles are exercised when they are used to bend the body and the upper and lower levers toward each other against the resistance of the spring.

The latter two devices require movement of the body in addition to the tightening and relaxing of the abdominal muscles. Undesirable twisting, bending, or stress on the backbone and tailbone may result. Also, the movement of the body requires the use of other muscles resulting in more rapid fatigue than if the abdominal muscles are exercised alone.

In contrast, the first two devices allow the exercising to be focused on the abdominal muscles. The first device, however, never allows the muscles to be completely relaxed because of the heavy weight which continuously presses down and must be counteracted to avoid injury or discomfort. The second device has somewhat limited utility because of the requirement to maintain the belt tightly around the abdomen. The repeated relaxing and tightening of the abdominal muscles causes the device to pull and chafe the skin. A device that allows the exercise to be focused on the adbominal muscles without injury or discomfort to the skin or body during use would provide significant advantages.

DISCLOSURE OF INVENTION

The present invention is directed to an abdominal exerciser having a first belt encircling the abdomen, a contacting means contacting the abdomen, a retaining means retaining the first belt spaced from the contacting means, and a biasing means biasing the retaining means away from the contacting means. The first belt and retaining means remain in a relatively stationary position away from the abdominal muscles when the muscles are exercised. The contacting means also remains fixed with respect to the skin during use. The spacing of the fixed elements of the exerciser from the skin substantially eliminates the pulling and chafing on the sides of the body inherent in prior art devices. Only the biasing means flexes. During use the abdominal muscles are tightened to push the contacting means toward the retaining means. The muscles are then relaxed allowing the biasing means to return the contacting means to a rest position.

In accordance with one important aspect of the invention, a weight is attached to the contacting means by a second belt. The weight aids in stretching the abdominal muscles by pushing them down when they are relaxed. The travel of the muscles from the fully relaxed to the fully tightened condition is thereby increased. The weight also increases the effort required to push the weight and contacting means toward the retaining means.

In a preferred embodiment, any belt may be used to attach the exerciser to the body. Belt apertures through the retainer means allow the exerciser to be secured to the belt. Similar belt apertures through the contacting means allow a second belt to hold the weight.

In accordance with another important aspect of the preferred embodiment, the biasing means is a coiled compression spring. The spring is held in position between the contacting and retainer means by three pairs of parallel radial slits on each defining spring retainer members. The spring retainer members on the contacting means project toward the retaining means and the spring retainer members on the retainer means project toward the contacting means.

MODES FOR CARRYING OUT THE INVENTION

Figure 1:
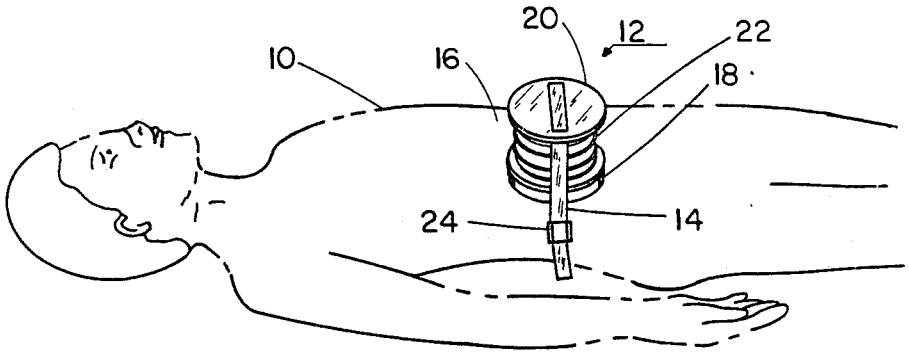
FIG. 1 is perspective view of a person using an abdominal exerciser in accordance with the present invention.

Referring initially to FIG. 1, there is illustrated a perspective view of a person 10 using an abdominal exerciser, generally designated 12, of the present invention. The exerciser 12 is used with a first belt 14 to encircle the abdomen 16 of the person. The exerciser includes a means for contacting the abdomen in the form of a planar contacting plate 18, a means for retaining the first belt 14 in the form of a retainer plate 20, and a means for biasing the retainer plate away from the contacting plate in the form of a coiled compression spring 22. A buckle 24 on the belt 14 allows the exerciser 12 to be easily installed about the abdomen 16 and preferrably has a slip type feature allowing the belt to be secured at any position along its length to permit the tension on the spring 22 to be adjusted as desired. Exercising of the abdominal muscles of the abdomen 16 is achieved by alternately tightening the muscles to push the contacting plate 18 toward the retainer plate 20 and relaxing the muscles allowing the spring 22 to push the contacting plate away from the retainer plate.

Figure 2:
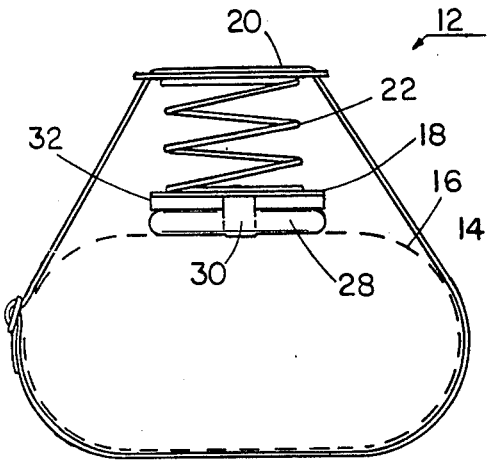
FIG. 2 is a side elevational view of the exerciser in a normal position on an abdomen.
Figure 3:
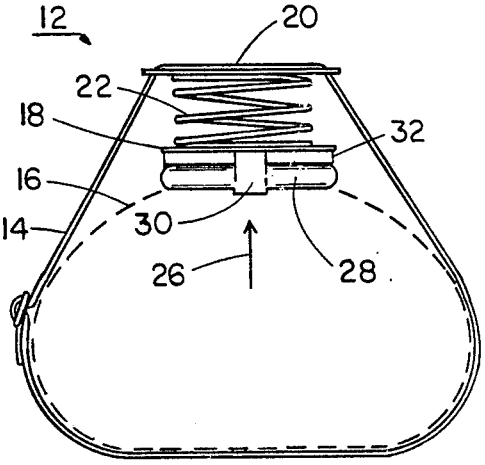
FIG. 3 is a side elevational view of the exerciser in a compressed position on an abdomen.

The process is clearly seen in FIGS. 2 and 3. FIG. 2 is a side elevational view of the exerciser 12 in a normal position, i.e. muscles relaxed, on the abdomen 16 (shown in sectional shadow outline). FIG. 3 is a side elevational view of the exerciser 12 in a compressed position, i.e. muscles tightened, pushing the contacting plate 18 upward toward the retainer plate 20 as indicated by the arrow 26. The distance of movement of the abdominal muscles from the position in FIG. 2 to the position in FIG. 3 is approximately 5 centimeters. As can be seen by a comparison of FIGS. 2 and 3, the belt 14 and retainer plate 20 remain in a relatively stationary position away from the abdominal muscles. The spacing of these elements from the body substantially eliminates the pulling and chafing of the skin inherent in prior art devices. Also, the contacting plate 18 remains fixed relative to the skin. Only the spring 22 flexes.

If desired, a weight 28 may be attached to the underside of the contacting plate 18 by a second belt 30. The abdominal muscles are thereby pushed further toward the center of the body when relaxed than when the weight 28 is not used. Increased travel of the muscles from the fully relaxed position illustrated in FIG. 2 to the fully tightened position illustrated in FIG. 3 is thereby achieved. Also, additional force is required to push the weight up. Both the additional travel and force increase the exercise achieved during each cycle.

In a preferred embodiment, a flexible insulating member such as plastic foam 32 is coupled to the contacting plate 18. The foam 32 provides more comfort for the abdomen when the exerciser 12 is used without the weight 28. When the weight is used, the foam 32 increases the friction between the contacting plate 18 and the weight to aid in maintaining the weight in place.

Figure 4:
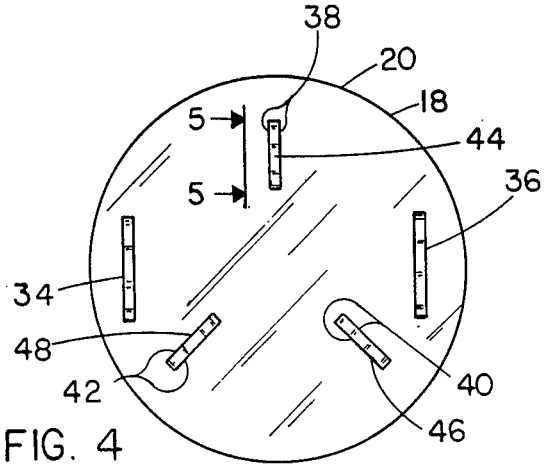
FIG. 4 is an enlarged bottom plan view of a retainer plate.

FIG. 4 is an enlarged bottom plan view of the retainer plate 20. The same plate is used in the inverted position for the contacting plate 18. The plates 18 and 20 are planar and are fabricated of metal. Two belt apertures 34 and 36 pass through the plates to hold the belts 14 or 30 in place. It will be appreciated that the retaining means and contacting means may be fabricated of plastic such as by injection molding or vacuum forming.

Also passing through each of the plates are three pairs of parallel radial slits 38, 40, and 42. The material between each pair of slits is stretched to create spring retainer members 44, 46, and 48 as shown in FIG. 5.

Figure 5:
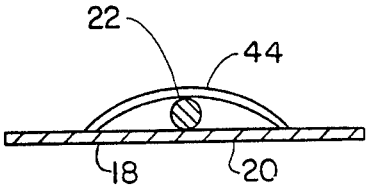
FIG. 5 is an enlarged sectional view along the line 5—5 of FIG. 4 showing a spring retainer member with a spring retained therein.

FIG. 5 is an enlarged sectional view along the line 5—5 of FIG. 4 showing the side of the spring retainer member 44. The spring 22 (shown in cross section) is added illustrating how the spring is flexibly retained by the retainer member 44. The spring may be removed from the plates 18, 20 by unscrewing and a spring having a different strength or travel installed. Alternately, two or more springs may be installed and retained in the retainer member 44.

It will be appreciated that the abdominal exerciser 12 may be used in positions other than that shown in FIG. 1. For example instead of lying flat, the person may do half sit ups. The exerciser 12 provides additional resistance in the same manner as described above. Alternatively, the person may sit in a chair while performing the tightening and relaxing exercises. An ancillary benefit of wearing the exerciser 12 while eating is a reduction of the appetite due to the pressure on the stomach.

In view of the above, it may be seen that an abdominal exerciser is provided which focuses the exercise activity on the abdominal muscles. Of course, the structure may be variously implemented depending upon specific applications. Accordingly, the scope hereof shall not be referenced to the disclosed embodiments, but on the contrary, shall be determined in accordance with the claims as set forth below.

I claim:

1. An abdominal exerciser, comprising:

a first belt for passing around the back of a user to retain said abdominal exerciser on the abdomen of said user;

means for contacting said abdomen;

means for retaining said first belt spaced from said contacting means; and means for biasing said retaining means away from said contacting means.

2. An exerciser according to claim 1 wherein said contacting means includes a planar contacting plate for contacting said abdomen.

3. An exerciser according to claim 2 wherein said contacting means further includes a flexible insulating member coupled to said plate for use betweeen said plate and said abdomen.

4. An exerciser according to claim 2 and further including a second belt and at least one weight wherein said contacting plate has at least two belt apertures therethrough for retaining said at least one weight on said plate by passing said second belt around said at least one weight and through said apertures.

5. An exerciser according to claim 1 wherein said retaining means has at least two belt apertures therethrough.

6. An exerciser according to claim 1 wherein said biasing means is a coiled compression spring.

7. An exerciser according to claim 6 wherein said contacting means includes a planar contacting plate for contacting said abdomen having at least three pairs of parallel radial slits therethrough defining spring retainer members, each of said spring retainer members projecting toward said retaining means.

8. An exerciser according to claim 7 wherein said retaining means includes a retainer plate having at least three pairs of parallel radial slits therethrough defining spring retainer members, each of said spring retainer members projecting toward said contacting means.

9. An exerciser according to claim 8 wherein:

said contacting means further includes:

a second belt;

at least one weight;

a flexible insulating member coupled to said plate for use between said plate and said abdomen; and at least two belt apertures therethrough for retaining said at least one weight on said plate by passing said second belt around said at least one weight and through said apertures; and said retainer plate further includes at least two belt apertures therethrough.

10. A method for exercising the abdominal muscles, comprising the steps of:

providing an abdominal exerciser having:

a first belt for passing around the back of a user;

a contacting means for contacting the abdomen of the user;

a retaining means for retaining said first belt spaced from said contacting means; and a biasing means biasing said retaining means away from said contacting means;

passing said first belt around said back of said user;

connecting said belt to retain said abdominal exerciser on said abdomen;

tightening said muscles to push said contacting means toward said retaining means; and relaxing said muscles allowing said biasing means to push said contacting means away from said retaining means.

11. The method for exercising the abdominal muscles as recited in claim 10 wherein:

the step of providing further includes a weight attached to said contacting means by a second belt;

the step of tightening said muscles further includes pushing said weight toward said retaining means; and the step of relaxing said muscles further includes allowing said weight to pull said contacting means away from said retaining means.

12. An abdominal exerciser, comprising:

a first belt for passing around the back of a user to retain said abdominal exerciser on the abdomen of said user;

means for contacting said abdomen including a planar contacting plate for contacting said abdomen, said contacting plate having at least two belt apertures therethrough;

means for retaining said first belt spaced from said contacting means;

means for biasing said retaining means away from said contacting means;

at least one weight;

a second belt; and said second belt retaining said at least one weight on said contacting plate by passing said second belt around said at least one weight and through said at least two belt apertures through said contacting plate.

13. An abdominal exerciser, comprising:

a first belt for passing around the back of a user to retain said abdominal exerciser on the abdomen of said user;

means for contacting said abdomen including:

a planar contacting plate for contacting said abdomen having at least three pairs of parallel radial slits therethrough defining spring retainer members and at least two belt apertures therethrough;

a second belt;

at least one weight;

a flexible insulating member coupled to said plate for use between said plate and said abdomen; and said second belt passing through said at least two belt apertures and around said at least one weight to retain said at least one weight on said planar contacting plate;

means for retaining said first belt spaced from said contacting means including a retainer plate having at least three pairs of parallel radial slits therethrough defining spring retainer members, each of said spring retainer members projecting toward said contacting means, and at least two belt apertures therethrough;

each of said spring retainer members on said planar contacting plate projecting toward said retaining means; and a coiled compression spring biasing said retaining means away from said contacting means.

14. A method for exercising the abdominal muscles, comprising the steps of:

providing an abdominal exerciser having:

a first belt for passing around the back of a user;

a contacting means for contacting the abdomen of the user;

a weight;

a second belt attaching said weight to said contacting means;

a retaining means for retaining said first belt spaced from said contacting means; and a biasing means biasing said retaining means away from said contacting means;

passing said first belt around said back of said user;

connecting said belt to retain said abdominal exerciser on said abdomen;

tightening said muscles to push said contacting means and said weight toward said retaining means; and relaxing said muscles allowing said biasing means to push said contacting means away from said retaining means and said weight to pull said contacting means away from said retaining means.

* * * * *

US004775148B1

REEXAMINATION CERTIFICATE (1834th)

United States Patent [19]

McLaughlin

[11] B1 4,775,148

[45] Certificate Issued Nov. 3, 1992

[54] ABDOMINAL EXERCISER

[76] Inventor: Gary G. McLaughlin, 13300 Wingo St., Arleta, Calif. 91331

Reexamination Request:
No. 90/002,415, Aug. 23, 1991

Reexamination Certificate for:

| | |
|---|---|
| Patent No.: | **4,775,148** |
| Issued: | **Oct. 4, 1988** |
| Appl. No.: | **59,,586** |
| Filed: | **Jun. 8, 1987** |

[51] Int. Cl.[5] ..... A63B 21/02

[52] U.S. Cl. ..... 482/124; 482/105; 482/121

[58] Field of Search ..... 272/1, 93, 99, 119, 272/135-143; 128/28; 482/13, 105, 121-130, 140, 148

[56] References Cited

U.S. PATENT DOCUMENTS

| | | | |
|---|---|---|---|
| 2,163,107 | 6/1939 | Shatto et al. | 272/119 |
| 2,220,593 | 11/1940 | Watson | 272/139 |
| 2,494,094 | 1/1950 | Horstman | 272/136 |
| 3,228,392 | 1/1966 | Speyer | 272/137 X |
| 3,278,185 | 10/1966 | Bidopia et al. | 272/139 |
| 3,888,245 | 6/1975 | Berntson et al. | 272/119 X |
| 4,076,237 | 2/1978 | Dussia | 272/135 X |
| 4,428,577 | 1/1984 | Weingardt | 272/135 |
| 4,603,858 | 8/1986 | Reehil | 272/137 |

OTHER PUBLICATIONS

Greither, O., *Fur Gesunde und Kranke,* Munich, Germany, Natur und Gesundheit, 1926, pp. 50-57.

Greither, O., *Gesund Durch Dick Selbst,* Munich, Germany, Kurt Desch, Inc., 1962, pp. 96-103.

*Primary Examiner*—R. D. Bahr

[57] ABSTRACT

An abdominal exerciser for use with a belt to encircle an abdomen. A planar contacting plate rests on the abdomen. A retainer plate spaced from the contacting plate retains the belt in a relatively fixed location away from the skin of the abdomen. A coiled compression spring biases the retainer plate and belt away from the contacting plate. Exercise of the abdominal muscles is achieved by alternatively tightening the muscles to push the contacting plate toward the retainer plate and then relaxing the muscles allowing the spring to push the contacting plate away from the retainer plate. In an alternative embodiment, a weight is attached to the contacting plate by a second belt to stretch the muscles in the relaxed state and to require greater effort when the contacting plate is pushed toward the retainer plate.

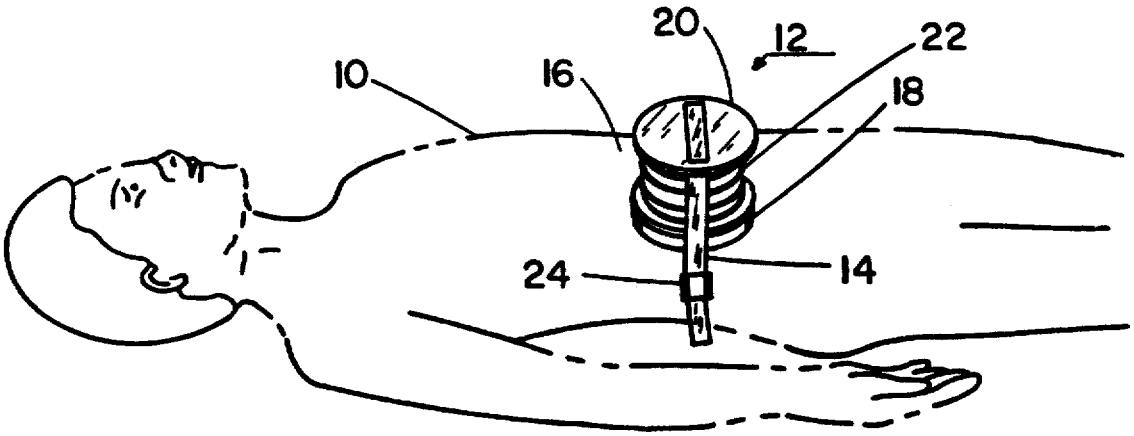

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, lines 9-25:

The process is clearly seen in FIGS. 2 and 3. FIG. 2 is a side elevational view of the exerciser 12 in a normal position, i.e. muscles relaxed, on the abdomen 16 (shown in sectional shadow outline). FIG. 3 is a side elevational view of the exerciser 12 in a compressed position, i.e. muscles tightened, pushing the contacting plate 18 upward toward the retainer plate 20 as indicated by the arrow 26. The distance of movement of the abdominal muscles from the position in FIG. 2 to the position in FIG. 3 is approximately 5 centimeters. As can be seen by a comparison of FIGS. 2 and 3, the belt 14 and retainer plate 20 remain in a relatively stationary position away from the abdominal muscles. The spacing of these elements from the body substantially eliminates the pulling and chafing of the skin inherent in prior art devices. Also, the contacting plate 18 remains fixed relative to the skin. Only the spring 22 flexes. *Therefore, the spring 22 serves as a stabilization element between the contact plate 18 and the retainer plate 20.*

AS A RESULT OF REEXAMINATION, IT HAS BEEN DETERMINED THAT:

The patentability of claims 4, 7-9 and 11-14 is confirmed.

Claims 1-3, 5, 6 and 10 having been finally determined to be unpatentable, are cancelled.

New claims 15-35 are added and determined to be patentable.

*15. An abdominal exercising apparatus comprising;*

*a contact element for contacting the abdomen of a user;*

*a retainer element spaced from the contact element away from the body of the user;*

*a compressible biasing element defining an interior space and mounted between the contact element and the retainer element for resiliently urging the contact element and the retainer element apart;*

*absent any element within the interior space for controlling movement of the retainer element relative to the contact element; and*

*an adjustable belt attached to the retainer element for passing around the body portion of the user to retain the retainer element at a fixed, selectable position away from the body of the user.*

*16. The exercising apparatus of claim 15 wherein the biasing element is a coil spring and the interior space is the space inside the coil.*

*17. An abdominal exerciser operable through a range of motion between a contracted abdominal position and an expanded abdominal position of a user comprising;*

*a contact element for contacting the abdomen of a user;*

*a retainer element spaced from the contact element away from the body of a user;*

*a compressible biasing element defining an interior space and mounted between the contact element and the retainer element for resiliently urging the contact element and the retainer element apart;*

*a stabilizing element operable between the retainer element and the contact element for keeping the retainer element and the contact element aligned and the stabilizing element being outside the interior space; and*

*an adjustable belt attached to the retainer element for passing around the back of a user to retain the retainer element at a fixed, selectable position away from the body of a user.*

*18. The abdominal exerciser of claim 17 wherein said range of motion has an upper limit and a lower limit and said stabilizer defines said upper and lower limits.*

*19. The abdominal exerciser of claim 18 wherein the biasing element is a coil spring and the interior space is the space inside the coil.*

*20. The abdominal exerciser of claim 19 wherein the coil spring is the stabilizing element.*

*21. The abdominal exerciser of claim 20 wherein the stabilizer element defines a cylinder between the contact element and the retainer element, the diameter of said cylinder being larger than the range of motion.*

*22. An abdominal exerciser comprising;*

*a contact element for contacting the abdomen of a user;*

*a retainer element spaced from the contact element away from the body of a user;*

*a stabilizing element of cylindrical shape operable between the retainer element and the contact element defining an exterior space outside the cylindrical shape of the stabilizing element;*

*a compressible biasing element between the contact element and the retainer element for resiliently urging the contact element and the retaining element apart, the biasing element not being in the exterior space; and*

*an adjustable belt attached to the retainer element for passing around the body of the user to retain the retainer element in a fixed selectable position away from the user's body.*

*23. The abdominal exerciser of claim 22 wherein the biasing element is a coil spring.*

*24. An abdominal exerciser operable through a range of motion between a contracted abdominal position and an expanded abdominal position of a user comprising;*

*a contact element for contacting the abdomen of a user and moveable with the user's abdomen between a contracted and an expanded abdominal position;*

*a retainer element spaced from the contact element away from the user's body retainable a relatively fixed distance away from the user's body;*

*the contact element and the retainer element defining a variable space between them said space being lesser in said expanded abdominal position and greater in said contracted abdominal position;*

*a stabilizing element operable between the retaining element and the contact element to maintain them in alignment during movement between the contracted and expanded abdominal positions said stabilizing*

*element being fully contained in said space within said range of motion;*

*an adjustable belt attached to the retainer element for passing around the body of the user to retain the retainer element at said relatively fixed distance; and*

*a compressible biasing element contained between the contact element and the retainer element resiliently urging the contact element and the retainer element apart.*

*25. The abdominal exerciser of claim 24 wherein said stabilizing element has a portion in contact with said contact element and a portion in contact with said retainer element, and said portions move in the range of movement with their respective contact and retainer elements.*

*26. The abdominal exerciser of claim 25 wherein the stabilizer element defines a cylindrical shape around a central axis between the contact element and the retainer element, the diameter of said cylindrical shape being larger than said range of movement.*

*27. An abdominal exerciser operable through a range of motion between contracted abdominal positions and expanded abdominal positions comprising;*

*a contact element for contacting the abdomen of a user and adopted to move with the user's abdomen between a contracted and an expanded abdominal position;*

*a retainer element spaced from the contact element away from the user's body and retainable a relatively fixed maximum distance away from the user's body;*

*a stabilizing element operable between the retaining element and the contact element to maintain them in alignment during use said stabilizing element absent any guiding rod fixed to the contact element and extending through a hole in the retainer element for guided relative travel of the retainer element and the rod when said contact element moves between a contracted and an expanded abdominal position and absent any depending rod fixed to the retainer element and extending toward the contact element;*

*a compressible biasing element contained between the contact element and the retainer element resiliently urging the contact element and the retainer element apart; and*

*an adjustable belt attached to the retainer element for passing around the body of the user to retain the retainer element at said relatively fixed distance.*

*28. The abdominal exerciser of claim 27 wherein said compressible biasing element is a coil spring and said absent guiding rod and said absent depending rod are absent from within said coil spring.*

*29. An abdominal exerciser operable through a range of motion between a contracted abdominal position and an expanded abdominal position comprising;*

*a contact element for contacting the abdomen of a user and moveable between a contracted and an expanded abdominal position;*

*a retainer element spaced from the contact element away from the user's body and retainable a relatively maximum distance away from the user's body;*

*the contact element and the retainer element defining a space between them said space being greater in said contracted abdominal position and being lesser in said expanded abdominal position;*

*absent any guiding rod fixed to the contact element and extending through a hole in the retainer element for guided relative travel between the retainer element and the rod when said contact element moves between a contracted and an expanded abdominal position;*

*a compressible biasing element contained between the contact element and the retainer element resiliently urging the contact element and the retainer element apart; and*

*an adjustable belt attached to the retainer element for passing around the body of the user to retain the retainer element at a fixed, selectable position away from the body of the user.*

*30. A method for exercising the abdominal muscles comprising the steps of;*

*providing an abdominal exercising apparatus comprising;*

*a contact element for contacting the abdomen of a user;*

*a retainer element spaced from the contact element away from the body of the user;*

*a compressible biasing element defining an interior space and mounted between the contact element and the retainer element for resiliently urging the contact element and the retainer element apart;*

*absent any element within the interior space for controlling movement of the retainer element relative to the contact element;*

*an adjustable belt attached to the retainer element for passing around the body portion of the user to retain the retainer element at a fixed, selectable position away from the body of the user;*

*passing said belt around the back of said user;*

*connecting said belt to fix the position of the retainer element;*

*expanding said muscles to push said contacting element toward said retainer element; and*

*relaxing said muscles allowing said biasing element to push said contacting element away from said retainer element.*

*31. A method for exercising the abdominal muscles comprising the steps of;*

*providing an abdominal exerciser operable through a range of motion between a contracted abdominal position and an expanded abdominal position of a user comprising;*

*a contact element for contacting the abdomen of a user;*

*a retainer element spaced from the contact element away from the body of the user;*

*a compressible biasing element defining an interior space and mounted between the contact element and the retainer element for resiliently urging the contact element and the retainer element apart;*

*a stabilizing element operable between the retainer element and the contact element for keeping the retainer element and the contact element aligned and the stabilizing element being outside the interior space; and*

*an adjustable belt attached to the retainer element for passing around the body portion of the user to retain the retainer element at a fixed, selectable position away from the body of the user;*

*passing said belt around the back of said user;*

*connecting said belt to fix the position of the retainer element;*

*expanding said muscles to push said contacting element toward said retainer element; and*

*relaxing said muscles allowing said biasing element to push said contacting element away from said retainer element.*

*32. A method for exercising the abdominal muscles comprising the steps of;*

*providing an abdominal exerciser comprising;*

*a contact element for contacting the abdomen of a user;*

*a retainer element spaced from the contact element away from the body of a user;*

*a stabilizing element of cylindrical shape operable between the retainer element and the contact element defining an exterior space outside the cylindrical shape of the stabilizing element;*

*a compressible biasing element between the contact element and the retainer element for resiliently urging the contact element and the retaining element apart, the biasing element not being in the exterior space;*

*an adjustable belt attached to the retainer element for passing around the body of the user to retain the retainer element a fixed selectable position away from the user's body;*

*passing said belt around the back of said user;*

*connecting said belt to fix the position of the retainer element;*

*expanding said muscles to push said contacting element toward said retainer element; and*

*relaxing said muscles allowing said biasing element to push said contacting element away from said retainer element.*

*33. A method for exercising the abdominal muscles comprising the steps of;*

*providing an abdominal exerciser having an abdominal exerciser operable through a range of motion between a contracted abdominal position and an expanded abdominal position of a user comprising;*

*a contact element for contacting the abdomen of a user and moveable with the user's abdomen between a contracted and an expanded abdominal position;*

*a retainer element spaced from the contact element away from the user's body retainable a relatively fixed distance away from the user's body;*

*the contact element and the retainer element defining a variable space between them said space being lesser in said expanded abdominal position and greater in said contracted abdominal position;*

*a stabilizing element operable between the retaining element and the contact element to maintain them in alignment during movement between the contracted and expanded abdominal positions said stabilizing element being fully contained in said space within said range of motion;*

*an adjustable belt attached to the retainer element for passing around the body of the user to retain the retainer element at said relatively fixed distance;*

*a compressible biasing element contained between the contact element and the retainer element resiliently urging the contact element and the retainer element apart;*

*passing said belt around the back of said user;*

*connecting said belt to fix the position of the retainer element;*

*expanding said muscles to push said contacting element toward said retainer element; and*

*relaxing said muscles allowing said biasing element to push said contacting element away from said retainer element.*

*34. A method for exercising the abdominal muscles comprising the steps of;*

*providing an abdominal exerciser operable through a range of motion between contracted abdominal positions and expanded abdominal positions comprising;*

*a contact element for contacting the abdomen of a user and adopted to move with the user's abdomen between a contracted and an expanded abdominal position;*

*a retainer element spaced from the contact element away from the user's body and retainable a relatively fixed maximum distance away from the user's body;*

*a stabilizing element operable between the retaining element and the contact element to maintain them in alignment during use said stabilizing element absent any guiding rod fixed to the contact element and extending through a hole in the retainer element for guided relative travel of the retainer element and the rod when said contact element moves between a contracted and an expanded abdominal position and absent any depending rod fixed to the retainer element and extending toward the contact element;*

*a compressible biasing element contained between the contact element and the retainer element resiliently urging the contact element and the retainer element apart;*

*an adjustable belt attached to the retainer element for passing around the body of the user to retain the retainer element at said relatively fixed distance;*

*passing said belt around the back of said user;*

*connecting said belt to fix the position of the retainer element;*

*expanding said muscles to push said contacting element toward said retainer element; and*

*relaxing said muscles allowing said biasing element to push said contacting element away from said retainer element.*

*35. A method for exercising the abdominal muscles comprising the steps of;*

*providing an abdominal exerciser operable through a range of motion between a contracted abdominal position and an expanded abdominal position comprising;*

*a contact element for contacting the abdomen of a user and moveable between a contracted and an expanded abdominal position;*

*a retainer element spaced from the contact element away from the user's body and retainable a relatively maximum distance away from the user's body;*

*the contact element and the retainer element defining a space between them said space being greater in said contracted abdominal position and being lesser in said expanded abdominal position;*

*absent any guiding rod fixed to the contact element and extending through a hole in the retainer element for guided relative travel between the retainer element and the rod when said contact element moves between a contracted and an expanded abdominal position;*

*a compressible biasing element contained between the contact element and the retainer element resiliently urging the contact element and the retainer element apart;* an adjustable belt attached to the retainer element for passing around the body of the user to retain the retainer element at a fixed, selectable position away from the body of the user;

*passing said belt around the back of said user;*

*connecting said belt to fix the position of the retainer element;*

*expanding said muscles to push said contacting element toward said retainer element; and*

*relaxing said muscles allowing said biasing element to push said contacting element away from said retainer element.*

* * * * *